United States Patent [19]

Christensen

[11] 4,341,568

[45] Jul. 27, 1982

[54] METHOD AND APPARATUS FOR WASHING OBJECTS

[75] Inventor: Kim S. Christensen, Redmond, Wash.

[73] Assignee: Beckman Instruments, Inc., Fullerton, Calif.

[21] Appl. No.: 163,602

[22] Filed: Jun. 27, 1980

[51] Int. Cl.[3] ..... B08B 3/02; B08B 5/04

[52] U.S. Cl. ..... 134/21; 15/302; 15/304; 134/34; 134/174; 134/182; 134/195; 134/198

[58] Field of Search ..... 15/302, 304; 134/94, 134/166, 174, 182, 195, 198, 21, 34

[56] References Cited

U.S. PATENT DOCUMENTS

| | | | |
|---|---|---|---|
| 2,884,936 | 5/1959 | Hilleman et al. | 134/148 |
| 3,073,727 | 1/1963 | Mullinix et al. | 134/21 |
| 3,492,396 | 1/1970 | Dalton et al. | 424/12 |
| 3,843,444 | 10/1974 | Likhite | 195/66 R |
| 3,849,830 | 11/1974 | Wagner | 15/302 |
| 3,949,771 | 4/1976 | Dodge et al. | 134/94 |
| 4,017,597 | 4/1977 | Reynolds | 424/1.5 |
| 4,046,593 | 9/1977 | Au et al. | 134/21 |
| 4,053,284 | 10/1977 | Posch | 23/259 |
| 4,101,284 | 7/1978 | Difiglio et al. | 23/259 |

OTHER PUBLICATIONS

"Uniwash II, Pentawash II, Coated Bead Washing Devices" by Abbott Laboratories, N. Chicago, Ill, 1975–Jun.

*Primary Examiner*—Chris K. Moore

*Attorney, Agent, or Firm*—R. J. Steinmeyer; Robert R. Meads; Timothy R. Schulte

[57] ABSTRACT

A device and method for washing an object in a receptacle. The device includes an end portion introducible into and cooperative with the receptacle to define a substantially enclosed space containing the object to be washed. The fluid is introduced into and aspirated from the substantially enclosed space such that the object is movable in the fluid between the end portion and the receptacle.

11 Claims, 4 Drawing Figures

METHOD AND APPARATUS FOR WASHING OBJECTS

BACKGROUND OF THE INVENTION

1. Field of the Invention

The invention relates to a method and device for washing and aspirating coated objects used in diagnostic assays. More particularly the invention is used to wash coated objects in the receptacles in which the diagnostic assay is performed. By way of further characterization, the invention includes a washing device which seals the receptacle into which it is inserted while injecting and aspirating cleaning fluid in a manner that produces movement of the coated object to permit complete cleaning thereof.

2. Description of the Related Art

In the diagnostic assay for the presence of hepatitis virus in blood, plastic beads coated with antibody are located in a tube-like receptacle or well. Patient serum is added to the receptacle. During incubation, antibody in the serum binds to the antibody. The serum is then removed from the receptacle and the bead is washed and aspirated with a cleaning fluid. Next, a reagent containing an antibody tagged with iodine-125 is added and binds to any antigen on the bead to form an antibody-antigen-antibody sandwich. The reagent is removed from the receptacle and the coated bead is again washed and aspirated with a cleaning fluid to ready the receptacle and coated bead for further processing in a gamma counter.

In the processing of the beads it is very important that the washing of the beads be complete to remove all serum and reagent and all unbound antigen and antibody. Further, it is extremely important that the washing step be accomplished without leakage or uncontrolled escape of the virus containing serum.

Previously, the washing of serum from beads was accomplished by repeated rinsing of the beads. That is, the washing fluid was poured over the bead and then rinsed from the receptacle containing the bead. When using this method it is difficult to remove all of the washing fluid such that a small amount of contaminated serum remains after each washing step. Therefore, although diluted by each subsequent washing, a small amount of the contaminated serum may remain even after repeated washings. Because removal of all the contaminated serum is important, this washing procedure has been less than satisfactory. An additional problem resulting from this procedure is that possible contamination due to spillage, splashing, or aerosolization of the washing substance may occur. This may present a danger to testing personnel and may contaminate associated apparatus.

In order to speed up the washing process, mechanical washing devices have been used. Devices presently marketed by Abbott Laboratories Inc. under the trademarks of UNIWASH and PENTAWASH and described in U.S. Pat. No. 3,949,771 use a wash probe which is lowered into the reaction tray well until the probe tip touches the bead and the tip is as far as possible into the well. An integral spray device is activated such that the washing substance is sprayed onto the sides of the well. A vacuum tube is positioned on the probe above the bead contact point such that the bead is retained against the device by the vacuum. While suited for its intended purpose, the device does not draw the washing substance over the entire surface of the bead.

That is, the contacted areas of the bead are not sufficiently washed to remove all of the contaminated serum. The proximity of the bead to the well hinders the circulation of the washing substance around the bottom of the bead. In addition, no provision is made for preventing contaminated washing substance from escaping the well as by splashing and spillage.

Another device, illustrated in U.S. Pat. No. 4,053,284 issued to N. A. Posch on Oct. 11, 1977, seals the well to prevent escape of contaminated serum from the well. This device uses a probe which is inserted into the well and which employs a stopper like device around its upper portion. The device is inserted into the well such that the washing portion extends into the well and the stopper seals the well from the outside atmosphere. The beads to be washed are contained in a reaction area at the bottom of the well. The reaction area is screened from the rest of the well such that the beads are prevented from moving to other parts of the well. The centermost portion at the bottom of the well is vacant such that the vacuum tube attached to the wash probe may extend near the bottom of the well. The washing fluid is drawn into the well by the vacuum through ports in the washing probe. The washing fluid then flows down the side of the well and over the beads. The fluid collects at the center of the well and is drawn up through the vacuum tube. While suited for its intended purpose, the beads are confined in the cleaning area by the screens and touch both each other and the walls of the well. As such, the entire surface of the beads may not be washed thereby allowing some contaminated hepatitis serum to remain on the beads. A single larger bead may be washed with this device in the same manner as the smaller beads. That is, the single large bead is washed by the same method except that no screening is necessary to keep the bead from being drawn up through the vacuum tube. Instead, the bead is positioned between the vacuum tube and the wall of the well. The bead thus contacts both the well and the side of the vacuum tube thereby hindering the circulation of the washing fluid and resulting in incomplete washing of the contacting surfaces.

It would be desirable to have an irrigating device in which the object may be moved by or suspended in the cleaning fluid in order that all surfaces of the object may be contacted by the fluid.

SUMMARY OF THE INVENTION

The invention is a method and device for washing an object within a receptacle. The object is substantially sealed within the receptacle. The object is washed such that it is movable between the device and the receptacle thus allowing the washing fluid to contact all surfaces of the object. The flow around the object is thus enhanced resulting in complete washing of the object.

An end portion of the device is introducible into and cooperative with the receptacle thereby defining a substantially enclosed space containing the object. The end portion includes a tip surface adjacent the object. A means for introducing a fluid into the substantially enclosed space is positioned adjacent the end portion. A means for aspirating the fluid from the substantially enclosed space is contiguous with the tip surface. The object is positioned between the aspirating means and the receptacle, being spaced from the aspirating means, and it is movable therebetween by the aspiration of the fluid.

In the preferred embodiment the device includes at least one high velocity nozzle mounted adjacent the tip surface. The aspirating means includes a vacuum tube extending beyond the tip surface. The portion of the vacuum tube extending beyond the tip surface is slotted to allow aspiration of the fluid even though the object may be adjacent the vacuum tube opening. The tip surface is configured to approximate a mating surface for at least part of the surface of the object to be washed. The end portion includes a shoulder which contacts a ridge on the receptacle. As such, the substantially enclosed space is sealed such that contaminated serum is prevented from escaping either by spillage or by aerosolization. The preferred embodiment of the device is used to wash coated beads which are spherical in shape. The tip surface is thus shaped concavely to allow the spherical bead to be drawn up adjacent the vacuum tube. The concave shape also improves the flow pattern over the spherical object.

DESCRIPTION OF THE PREFERRED EMBODIMENT

Figure 1:
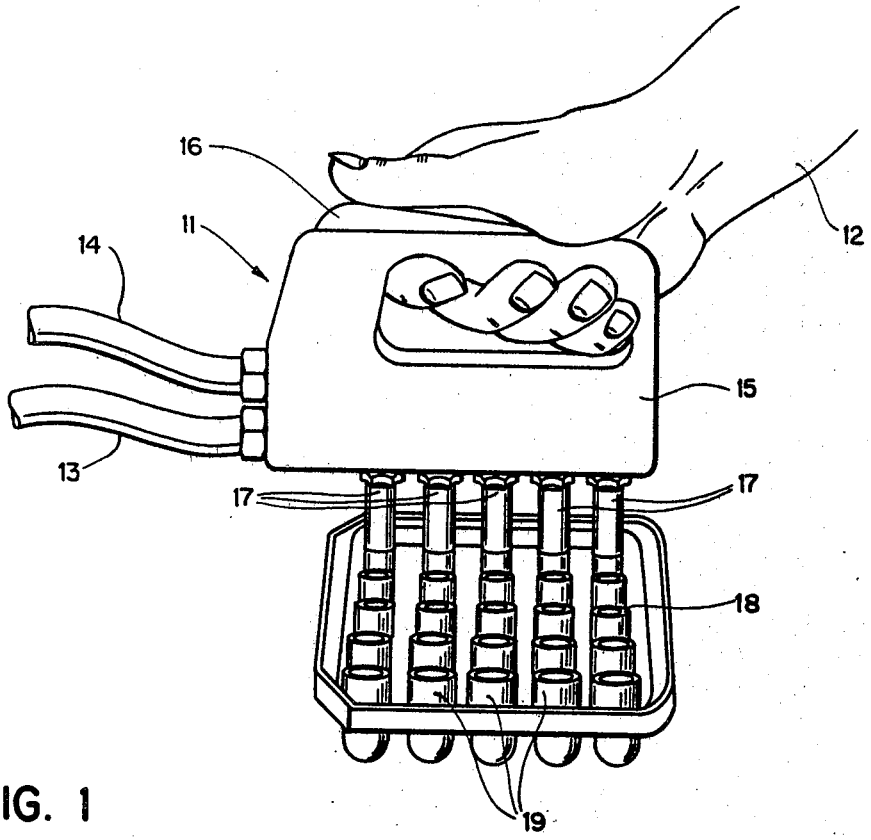
FIG. 1 is a perspective view of the invention as used to wash objects contained in a plurality of receptacles.

Like reference numerals denote like structure throughout each of the various figures. Referring to FIG. 1, the device generally indicated as 11 is used by an operator 12. An inlet hose 13 and an outlet hose 14 respectively introduce and remove the washing fluid from the device. A handle case 15 and an exhaust control 16 are held by operator 12. A plurality of tubes 17 are connected to handle 15. Each of tubes 17 contact a ridge 18 on each of a plurality of wells 19.

Figure 2:
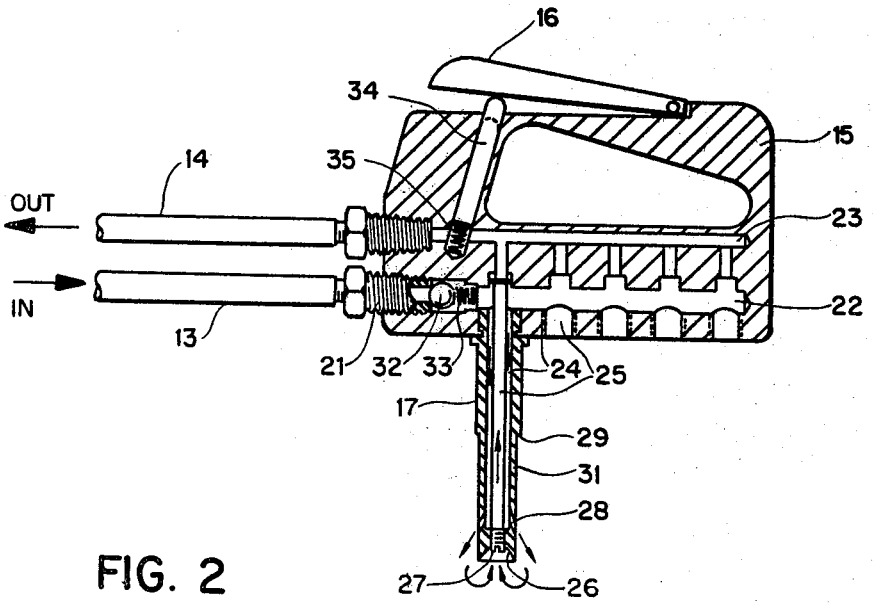
FIG. 2 is a sectional view of the invention illustrating the inlet and outlet paths for the washing fluid.

Referring to FIG. 2, a sectional view of the device is illustrated. Inlet hose 13 and outlet hose 14 are connected to handle 15 and communicate with an inlet passage 22 and an outlet passage 23, respectively. Inlet passage 22 communicates with inlet hose 13 through a connector 21 and with an inlet tube 24 contained within each of the tubes 17. Outlet passage 23 communicates with an aspirating means which may include a vacuum tube 25 within each of tubes 17. In the preferred embodiment vacuum tube 25 and inlet tube 24 are concentrically mounted with tube 17. For purposes of illustration, only one tube 17 is shown in detail in FIG. 2. Each of tubes 17 terminate in a tip surface 26. In the preferred embodiment tip surface 26 is concavely shaped so as to mate with a spherical object. A means for preventing the object from contacting vacuum tube 25 includes a slotted extension 27. Slotted extension 27 extends beyond tip surface 26 and toward the object (not shown).

Referring again to FIG. 2, an introducing means which may include a plurality of high velocity nozzles 28 connect to inlet tubes 24 and allow the washing fluid to be introduced into the enclosed space defined by tube 17 and well 19 (shown in FIG. 1). A shoulder 29 on tube 17 substantially seals to ridge 18 (shown in FIG. 1) to define the substantially enclosed space within well 19. An end portion 31 of tube 17 is defined between shoulder 29 and tip surface 26. A means for regulating the introducing of the washing fluid comprises a ball 32 and a spring 33 in inlet passage 22. An exhaust valve comprising a plug 34 and a spring 35 communicates with outlet passage 23 and is activated by trigger 16.

Figure 3:
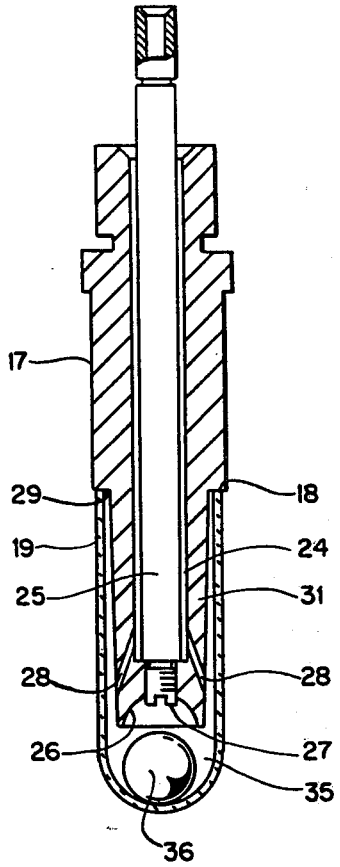
FIG. 3 is an enlarged partial sectional view of the end portion of the invention as positioned in the receptacle.

Referring to FIG. 3, tube 17 and well 19 are shown in partial sectional view. Shoulder 29 on tube 17 cooperates with ridge 18 on well 19 to define substantially enclosed space 35. End portion 31 terminates in tip surface 26. Vacuum tube 25 terminates in extension 27. Inlet tube 24 communicates with high velocity nozzles 28 which in turn communicate with substantially enclosed space 35. An object 36 is contained within substantially enclosed space 35. Object 36 is positioned between tip surface 26 and the bottom of well 19.

Figure 4:
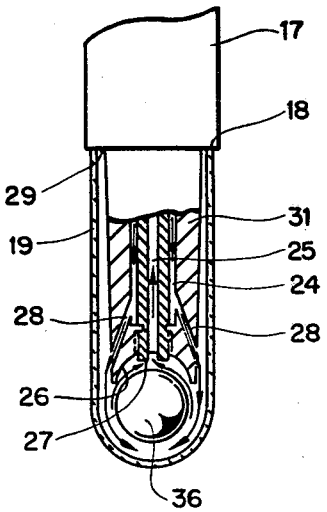
FIG. 4 is an enlarged sectional view of the end portion of the invention illustrating the tip surface thereof and the flow of the washing fluid around a spherical object.

Referring to FIG. 4, end portion 31 is shown in sectional view to illustrate the aspiration of the substance. Shoulder 29 on tube 17 mates with ridge 18 on well 19. End portion 31 extends into well 19. Vacuum tube 25 terminates in extension 27 which protrudes beyond tip surface 26. High velocity nozzles 28 communicate with substantially enclosed space 35 on one end and with inlet tube 24 at the other end. Object 36 is contained within substantially enclosed space 35.

MODE OF OPERATION

Referring to FIGS. 1 and 2, the washing device is used to wash well 19 and an object or objects contained therein. Operator 12 controls the flow of the washing fluid through the device by the use of trigger 16. Referring to FIG. 2, trigger 16 contacts spring loaded plug 34. Plug 34 is biased in the open position by spring 35. By depressing trigger 16, plug 34 is moved downward thereby blocking outlet passage 23. A vacuum source (not shown) connected to tube 14 is thus cut off from outlet passage 23 thereby eliminating the vacuum in outlet passage 23 and vacuum tube 25. The flow of washing fluid from the device through tube 13 is controlled by a check valve which includes ball 32 and spring 33. Ball 32 is held against connector 21 by spring 33 thus preventing the flow of washing fluid from the device. When plug 34 is in the up position, that is, when trigger 16 is not depressed, the vacuum created in the device through tube 14 is sufficient to draw the washing fluid into the device by overcoming the biasing force provided by spring 33 allowing ball 32 to be pushed away from connector 21. When the trigger 16 is depressed, the vacuum is cut off and spring 33 again biases ball 32 against connector 21 thereby cutting off the flow of the washing fluid to the device. The check valve also prevents the siphoning of the washing fluid from wells 19. Operator 12 is thus able to control both the input and output of the washing fluid to and from the device.

Referring to FIG. 2, the washing fluid is introduced through inlet tube 13 and into inlet passage 22. The fluid is then conveyed down inlet tube 24 and out of high velocity nozzles 28 into wells 19. Although, for ease of illustration, only one tube 17 is shown in FIG. 2, it should be understood that a plurality of tubes 17 may be included on the device. The washing fluid, after being injected into well 19 by nozzle 28, is aspirated through extension 27 and up vacuum tube 25 to outlet passage 23. The fluid is then evacuated from the device through outlet tube 14.

Referring to FIG. 3, tube 17 is shown along with a well 19 in partial sectional view. End portion 31 is inserted into well 19 such that shoulder 29 mates with ridge 18 on well 19 substantially sealing the inside of well 19 and thereby defining a substantially enclosed space 35 within well 19. The leakage of any washing fluid from well 19 is thus prevented. In addition, if the device is used for cleaning purposes as during hepatitis virus testing or the like, any contamination due to leakage or aerosolization of the washing fluid or other substances within well 19 is prevented. For hepatitis testing a glass or plastic bead may be used as object 36. Object 36 is contained within substantially enclosed space 35. Tip surface 26 is configured to approximate a spherical surface such that at least a part of a spherical bead may be received therein. The tip surface configuration improves the flow pattern of the washing fluid around the spherical object.

Referring to FIG. 4, end portion 31 is shown in sectional view to illustrate the operation of the device. Specifically, the washing fluid is drawn through inlet tube 24 and high velocity nozzles 28 and injected into substantially enclosed space 35. The flow of the washing fluid moves object 36 away from the bottom of well 19. That is, the washing fluid is injected into substantially enclosed space 35 and is exhausted through vacuum tube 25 such that the flow of the fluid around object 36 causes object 36 to be moved upward adjacent tip surface 26. Object 36 is thus suspended in and contacted on all surfaces by the washing fluid. Greater rinsing action is thus achieved. Extension 27 protrudes beyond tip surface 26 such that it prevents object 36 from sealing off vacuum tube 25 if the object is drawn up that far. That is, extension 27 is slotted such that contact by object 36 will not prevent the aspiration of the fluid from substantially enclosed space 35. The contact area of extension 27 is small enough so as not to prevent the washing of any surface area on object 36. When the vacuum is shut off as by the depressing of trigger 16 by the operator 12, then object 36 drops back onto well 19.

The curvature of tip surface 26 along with the action of the washing fluid when introduced into substantially enclosed space 35 results in a flow pattern for the fluid which carries the fluid around all surfaces of object 36. A better rinsing action may be thus achieved. This is especially important if the device is used in hepatitis virus testing because it is important to remove all of the serum from the glass bead. In prior devices the glass bead contacted either the well or the washing device or both. Because not all of the bead surface was exposed, incomplete washing resulted. With the present invention all surfaces of the bead are contacted by the washing fluid and thus all traces of serum may be removed from the bead.

Another advantage of the present invention is that it may be autoclaved. That is, the device is designed such that exposure to high temperature steam will not adversely affect its performance. The check valve defined by ball 32 and spring 33 and the exhaust valve defined by plug 34 and spring 35 are simple in construction and operation. The valves will not freeze up after autoclaving. The rest of the device is also constructed of materials which will not be affected adversely by exposure to high temperature steam. Because the device may be autoclaved, the possibility of contamination to an operator is reduced. This is especially important when the device is used during testing for highly contageous viruses such as hepatitis.

While a particular form of the invention has been described with respect to a particular embodiment thereof, it is not to be so limited as changes and modifications may be made therein which are within the full intended scope of the invention as defined by the appended claims. For example, while the invention has been illustrated for use with a spherical object 36, it is possible that other objects of a different shape may be washed by the device. Modifications to the substantially concave tip surface 26 such that the tip surface 26 is capable of receiving a portion of a different shaped object would be required. Additionally, while one tube 17 has been described and five tubes 17 have been illustrated in FIG. 1, it is to be expressly understood that any number of tubes 17 may be utilized without departing from the scope of the invention. For instance, it may be desired to have only one tube to wash each well individually. Alternatively, it may be desired to wash a row of wells as is illustrated in FIG. 1. It would also be within the scope of the invention to utilize a device which washes all of the wells at once. That is, tube 17 need not be in a single row. The use of testing trays having well placement other than that illustrated in FIG. 1 may necessitate different placement or numbers of tubes 17.

Other contemplated uses of the invention include its use as a coating device. That is, the substance to be introduced could be of a nature so as the bond to the object. Excess coating substance may be aspirated from the well. The unique advantages of the invention would assure even coating on all surfaces of the object. While the washing fluid is contemplated as a liquid it is to be expressly understood that a powder, gas, etc. may be utilized with the device without departing from the scope of the invention.

The foregoing description, taken together with the appended claims, constitutes a disclosure which enables one skilled in the art and having the benefit of the teachings contained therein to make and use the invention. Further, the structure herein described constitutes a meritorious advance in the art which is unobvious to such skilled workers not having the benefit of these teachings.

What is claimed is:

1. A device for washing an object within a receptacle comprising:

an end portion introducible into and cooperative with said receptacle in such a way as to define a substantially enclosed space containing said object;

said end portion including a tip surface adjacent said object;

means, adjacent said end portion, for introducing a fluid into said substantially enclosed space; and means, contiguous with said tip surface, for aspirating said fluid from said substantially enclosed space;

said object being movable between said receptacle and said tip surface.

2. The device according to claim 1 wherein said end portion includes a shoulder substantially sealing with said receptacle.

3. A device for washing an object within a receptacle comprising:

an end portion introducible into and cooperative with said receptacle in such a way as to define a substantially enclosed space containing said object;

said end portion including a tip surface adjacent said object;

at least one high velocity nozzle mounted adjacent said tip surface;

an aspirator contiguous with said tip surface;

said tip surface configured to approximate a mating surface for at least part of a surface of said object, said tip surface spaced from said part of said object surface to allow movement of said object between said tip surface and said receptacle.

4. The device according to claim 3 wherein said end portion includes a shoulder substantially sealing with a ridge on said receptacle.

5. A method for washing an object within a receptacle comprising the steps of:

inserting at least a portion of a washing device into said receptacle such that said portion and said receptacle cooperate to substantially enclose the object therebetween, the object being positioned between said receptacle and a tip surface on said portion;

injecting a fluid into said receptacle adjacent said object; and aspirating said fluid from said receptacle so as to move said object between said tip surface and said receptacle.

6. The method of claim 5 wherein said step of inserting includes substantially sealing a shoulder on said washing device with said receptacle.

7. The method of claim 5 wherein said step of injecting includes introducing the fluid such that it will flow between said object and said receptacle.

8. The method of claim 5 wherein said step of aspirating includes vacuuming said fluid from around said object such that said substance is drawn over all surfaces of said object.

9. A device for washing an object within a receptacle comprising:

an end portion introducible into and cooperative with said receptacle in such a way as to define a substantially enclosed space containing said object;

said end portion including a tip surface adjacent said object;

means, adjacent said end portion, for introducing a fluid into said substantially enclosed space;

a vacuum tube contiguous with said tip surface; and means, attached to said vacuum tube and extending beyond said tip surface, for preventing said object from contacting said vacuum tube;

said object being movable between said receptacle and said tip surface.

10. The device according to claim 9 wherein said preventing means includes a slotted extension contiguous with said vacuum tube.

11. A device for washing an object within a receptacle comprising:

an end portion introducible into and cooperative with said receptacle in such a way as to define a substantially enclosed space containing said object;

said end portion including a tip surface adjacent said object;

at least one high velocity nozzle mounted adjacent said tip surface; and an aspirator contiguous with said tip surface;

said aspirator including a slotted extension protruding beyond said tip surface;

said tip surface configured to approximate a mating surface for at least part of a surface of said object, said tip surface spaced from said part of said object surface to allow movement of said object between said tip surface and said receptacle.

* * * * *